US009093231B2

(12) United States Patent
Fujita et al.

(10) Patent No.: US 9,093,231 B2
(45) Date of Patent: Jul. 28, 2015

(54) SWITCH

(71) Applicant: OMRON CORPORATION, Kyoto-shi, Kyoto (JP)

(72) Inventors: Hiroyuki Fujita, Okayama (JP); Hiroto Yonehara, Tottori (JP); Kenichi Ando, Okayama (JP)

(73) Assignee: OMRON Corporation, Kyoto (JP)

( * ) Notice: Subject to any disclaimer, the term of this patent is extended or adjusted under 35 U.S.C. 154(b) by 186 days.

(21) Appl. No.: 13/791,740

(22) Filed: Mar. 8, 2013

(65) Prior Publication Data

US 2013/0256104 A1 Oct. 3, 2013

(30) Foreign Application Priority Data

Mar. 9, 2012 (JP) ..... 2012-053564

(51) Int. Cl.

| | |
|---|---|
| ***H01H 1/40*** | (2006.01) |
| ***H01H 1/36*** | (2006.01) |
| ***H01H 13/14*** | (2006.01) |
| *H01H 1/58* | (2006.01) |
| *H01H 13/52* | (2006.01) |

(52) U.S. Cl.

CPC ..... *H01H 1/36* (2013.01); *H01H 1/365* (2013.01); *H01H 1/40* (2013.01); *H01H 13/14* (2013.01); *H01H 1/5866* (2013.01); *H01H 13/52* (2013.01)

(58) Field of Classification Search

CPC ..... H01H 13/10; H01H 13/12; H01H 1/365
USPC ..... 200/530–533, 284
See application file for complete search history.

(56) References Cited

U.S. PATENT DOCUMENTS

| | | | | |
|---|---|---|---|---|
| 3,104,300 | A | 9/1963 | Hutt | |
| 5,041,706 | A | 8/1991 | Osika et al. | |
| 5,304,753 | A | 4/1994 | Parrish et al. | |
| 5,803,242 | A * | 9/1998 | Takano et al. | 200/530 |
| 2006/0243576 | A1 * | 11/2006 | Kuwana et al. | 200/329 |

FOREIGN PATENT DOCUMENTS

| | | | |
|---|---|---|---|
| CN | 1078963 | C | 2/2002 |
| DE | 4338762 | | 11/1993 |
| FR | 2545976 | | 5/1984 |
| GB | 1081383 | | 8/1967 |
| JP | U3169859 | A | 8/2011 |

* cited by examiner

*Primary Examiner* — Renee Luebke
*Assistant Examiner* — Ahmed Saeed
(74) *Attorney, Agent, or Firm* — Klarquist Sparkman, LLP

(57) ABSTRACT

The present invention provides a switch having a small longitudinal size of movable contacts and reduced size. The switch includes a base, a pair of fixing terminals standing on an upper surface of the base, an insulating wall section integrated with at least one of the fixing terminals, a push button arranged to be upward and downward movable in the axial direction, and a slider movable upward and downward with the push button. The slider has elastic arm sections in both ends thereof, the elastic arm sections being provided with movable contact portions to be brought into sliding contact with the fixing terminals or the insulating wall section while pressing the fixing terminals or the insulating wall section from one side The switch is configured to enable the movable contact portions to connect to and separate from the fixing terminals based on operation of the push button upward and downward.

5 Claims, 14 Drawing Sheets

SWITCH

BACKGROUND OF THE INVENTION

1. Technical Field

The present invention relates to a switch, particularly to a microswitch for detecting operations of operating parts of an automobile, home appliances, and the like, further to a microswitch including a sliding contact structure.

2. Related Art

Conventionally, as a microswitch provided with a sliding contact mechanism, for example, Japanese Utility Model No. 3169859 describes a switch having movable contact portions for nipping fixed contacts in the direction orthogonal to the longitudinal direction in both longitudinal ends of movable contact terminals for switching a conduction state between the fixed contacts.

However, in the above switch, since the movable contact portions provided in both the longitudinal ends of the movable contacts nip the fixed contacts in the direction orthogonal to the longitudinal direction, longitudinal size of the movable contacts cannot be effectively utilized. Therefore, there is a problem that the switch cannot be reduced in size.

SUMMARY

The present invention has been devised to solve the problem described above, and an object thereof is to provide a switch capable of decreasing longitudinal size of movable contacts and decreasing the size of the switch.

In accordance with one aspect of the present invention, a switch according to the present invention is a switch including a base, a pair of fixing terminals standing on an upper surface of the base so as to face each other, an insulating wall section integrated with at least one of the fixing terminals, a push button arranged so as to move upward and downward in the axial direction, and a slider moved upward and downward integrally with the push button, wherein the slider has elastic arm sections in both ends thereof, the elastic arm sections being provided with movable contact portions to be brought into sliding contact with the fixing terminals or the insulating wall section while pressing the fixing terminals or the insulating wall section from one side, and by moving the push button upward and downward, the movable contact portions provided in the elastic arm sections are connected to or separated from the fixing terminals.

Since the elastic arm sections are provided in both the ends of the slider, at the time of ensuring a predetermined contact force, a better contact between the contact portions and fixing terminals can be ensured. Therefore, even when variations are generated in contact force due to variations in part precision and assembling precision, variations in a contact force can be minimized. As a result, a switch with low variations in operation characteristics can be obtained.

Since there is a space in the longitudinal direction of the slider, the space in the width direction of the switch can be effectively utilized to reduce the size of the switch in such direction.

As an embodiment of the present invention, an inward surface of the fixing terminal and an inward surface of the insulating wall section may be in a same plane.

Thereby, the slider can be brought into smooth sliding contact between the insulating wall section and a first fixing terminal.

As another embodiment of the present invention, the elastic arm sections may have elastic pieces sheared and bent into a substantially V shape.

Thereby, at the time of assembling the switch, the fixing terminals can be inserted and assembled inside the switch so as to be guided by the elastic pieces of the slider, so that an assembling property is improved.

As a different embodiment of the present invention, the elastic arm sections may include support pieces extending from both side edges of a coupling body and being bent in the same direction, and the elastic pieces sheared and bent outward from the support pieces into a substantially V shape, and the movable contact portions may be provided in tip ends of the elastic pieces.

Since the V shape elastic arm sections include the support pieces and the elastic pieces, stock layout of the slider becomes efficient, so that a stock width can be narrowed. Since the elastic arm sections are formed in a V shape, a distance from a center axis of the push button to the movable contact portions is shortened. Thus, even in a case where the push button is inclined, an influence on a contact switch position can be reduced.

Each of the fixing terminals may include a slide contact section to be brought into sliding contact with the slider, and an externally connecting terminal section connected to an external circuit, the slide contact section and the externally connecting terminal section may be coupled so as to have a predetermined twist angle via a coupling section, and the coupling section may be buried in the base.

According to the above configuration, strength for supporting the fixing terminals onto the base is enhanced, so that the fixing materials are not easily dropped from the base. Since a creeping distance between the base and the fixing terminals can be extended, sealing airtightness is improved.

As a different embodiment of the present invention, movable contact portions provided on both sides of the slider may be respectively arranged at positions which are different from a rotation symmetry with respect to a center axis of the push button, and the fixing terminals may be arranged in such a manner that in a case where the slider is rotated by 180° with respect to the center axis in a state that one of the movable contact portions is in contact with the insulating wall section at an initial position serving as a position before pressing the push button, the other movable contact portion is brought into contact with the fixing terminal.

Thereby, switches of two specifications including an always-closed contact structure and an always-open contact structure can be made by the same constituent parts. Without changing a shape of the pair of elastic arm sections, the switches of the two specifications can be obtained.

As a different embodiment of the present invention, the slider may be insert-molded to the push button.

Thereby, the slider is integrated with the push button, so that the number of parts and the number of assembling steps are decreased, and the variations in the operation characteristics of the slider are eliminated, so that contact reliability can be enhanced.

As another embodiment of the present invention, the slider may be integrated with the push button by thermal caulking or snap-fitting. Thereby, there is an effect that a selection range of an assembling method is widened, so that the switch is easily manufactured.

BRIEF DESCRIPTION OF THE DRAWINGS

FIG. 2B is an exploded perspective view in which FIG. 2A is seen from the lower side;

FIG. 3B is a perspective view in which FIG. 3A is seen from the lower side;

FIG. 6B is an exploded perspective view in which FIG. 6A is seen from the lower side;

FIG. 8B is an exploded perspective view in which FIG. 8A is seen from the lower side;

FIG. 12B is an exploded perspective view in which FIG. 12A is seen from the lower side;

DETAILED DESCRIPTION

Embodiments of a switch according to the present invention will be described in accordance with FIGS. 1 to 14A and 14B.

First Embodiment

Figure 1:
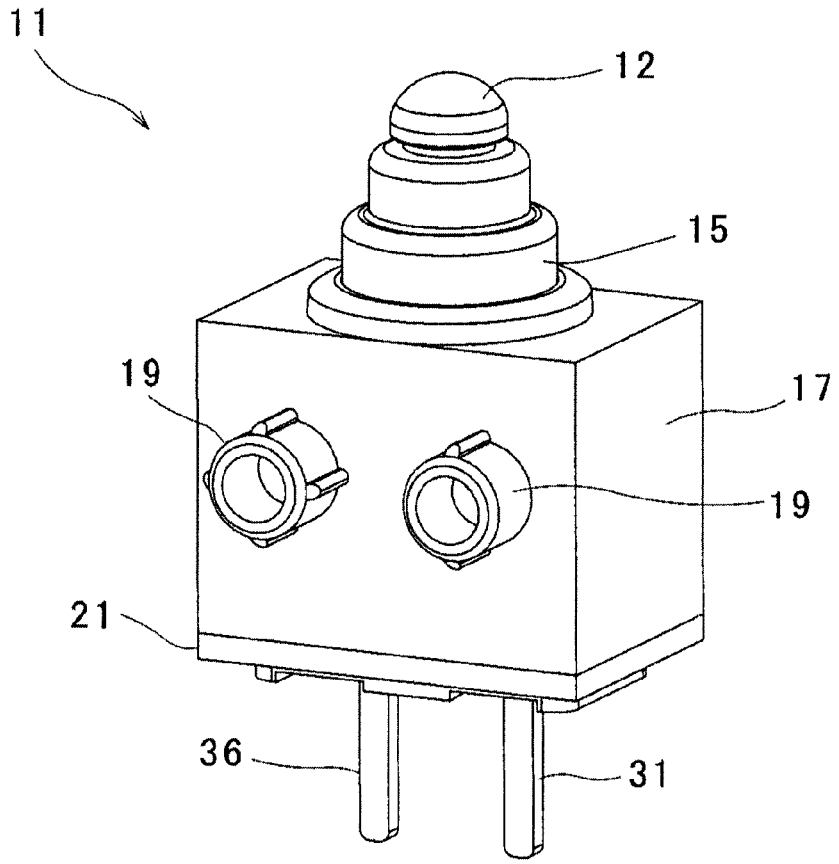
FIG. 1 is a perspective view showing a switch according to the present invention.
Figure 2A:
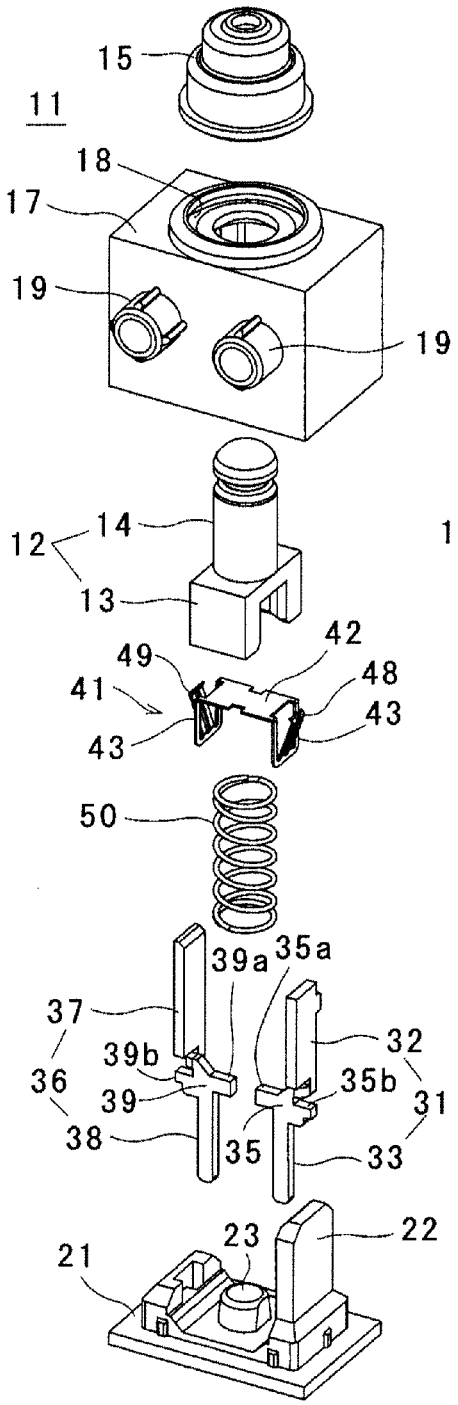
FIG. 2A is an exploded perspective view in which a switch according to a first embodiment of the present invention is seen from the upper side.
Figure 2B:
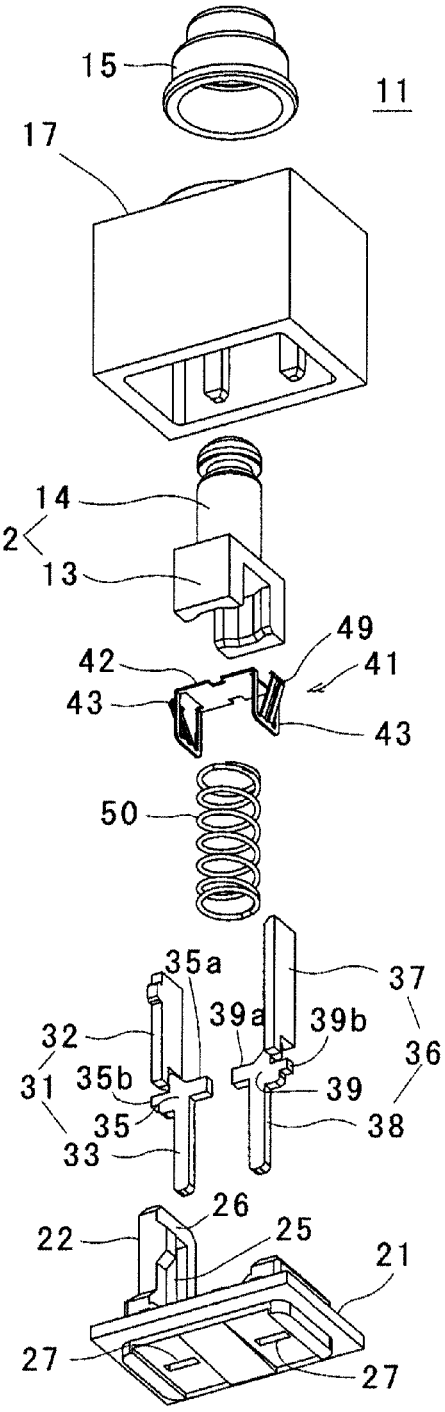

A switch 11 according to a first embodiment includes a push button 12, a casing 17, a base 21, a first fixing terminal 31, a second fixing terminal 36, and a slider 41 as shown in FIGS. 1, 2A, and 2B.

The push button 12 has a seat 13 in which a recessed portion is formed, and a cylindrical pressed section 14 extending upward from the seat 13 in the axial direction. The push button 12 is arranged inside the casing 17 movably in the axial direction orthogonal to the base 21, and an upper end of the pressed section 14 protrudes upward from the casing 17 through a cylindrical cap 15. Therefore, the pressed section 14 is pressed from an exterior, so that the push button 12 is moved in the axial direction.

The casing 17 is formed in a box shape in which a bottom portion is opened, and has an annular groove 18 formed on an upper surface thereof, the annular groove through which the pressed section 14 of the push button 12 is inserted, and a pair of annular positioning projections 19 horizontally protruding from a side surface thereof.

The base 21 is a plate shape resin body for closing an opening in the bottom portion of the casing 17. In the base 21, an insulating wall section 22 extending upward is integrally formed on an upper surface thereof, and a cylindrical rib 23 protruding upward is provided in a center of the base 21. The insulating wall section 22 includes a burying groove 25 formed in a rectangular shape in a front view and provided on an inner surface thereof, the burying groove into which the first fixing terminal 31 is buried, and an insulation portion 26 provided on the upper side of the burying groove 25. Further, terminal holes 27 through which the first fixing terminal 31 and the second fixing terminal 36 are inserted are formed in the base 21.

The first fixing terminal 31 is made of metal, and has a rectangular plate shape first slide contact section 32 formed in an upper half part thereof extending in the axial direction, and a rectangular plate shape first externally connecting terminal section 33 formed in a lower half part thereof extending in the axial direction. The first slide contact section 32 and the first externally connecting terminal section 33 are coupled so as to have a right twist angle. A first inward projection 35*a*, and a first outward projection 35*b* protruding on the opposite side of the first inward projection 35*a* are formed in a coupling section 35. In a state that the first fixing terminal 31 is fixed to the base 21 via the terminal hole 27, the first slide contact section 32 is buried in the burying groove 25 so as to be flush with the insulation portion 26 and brought into sliding contact with the slider 41 moved in the axial direction. Meanwhile, the first externally connecting terminal section 33 is exposed downward from the terminal hole 27 and connected to an external terminal (external circuit (not shown)).

The second fixing terminal 36 is made of metal, and has a rectangular plate shape second slide contact section 37 formed in an upper half part thereof extending in the axial direction, and a rectangular plate shape second externally connecting terminal section 38 formed in a lower half part thereof extending in the axial direction. The second slide contact section 37 and the second externally connecting terminal section 38 are coupled so as to have a right twist angle. A second inward projection 39*a*, and a second outward projection 39*b* protruding on the opposite side of the second inward projection 39*a* are formed in a coupling section 39. The second slide contact section 37 is formed to be longer than the first slide contact section 32 of the first fixing terminal 31. In a state that the second fixing terminal 36 is fixed to the base 21 via the terminal hole 27, the second slide contact section 37 is always in contact with the slider 41. Meanwhile, the second externally connecting terminal section 38 is exposed downward from the terminal hole 27 and connected to an external terminal (not shown).

Figure 3A:
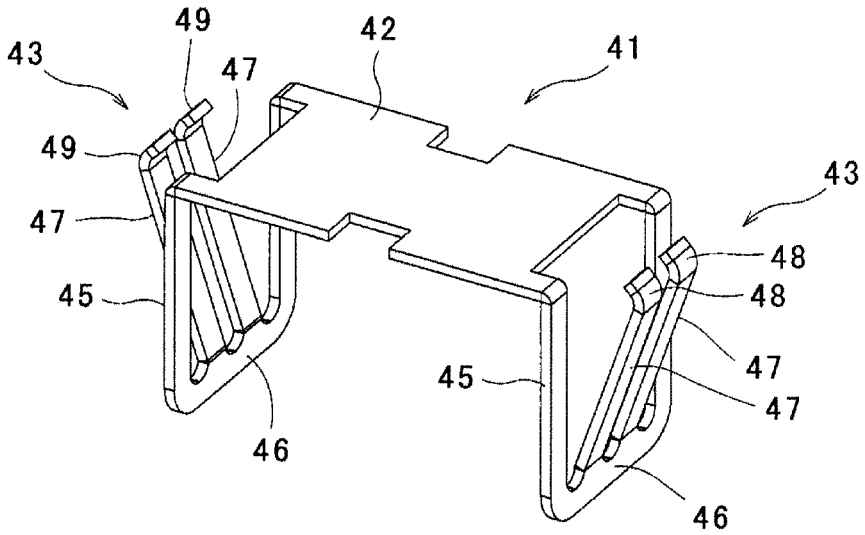
FIG. 3A is a perspective view in which a slider of FIGS. 2A and 2B is seen from the upper side.
Figure 3B:
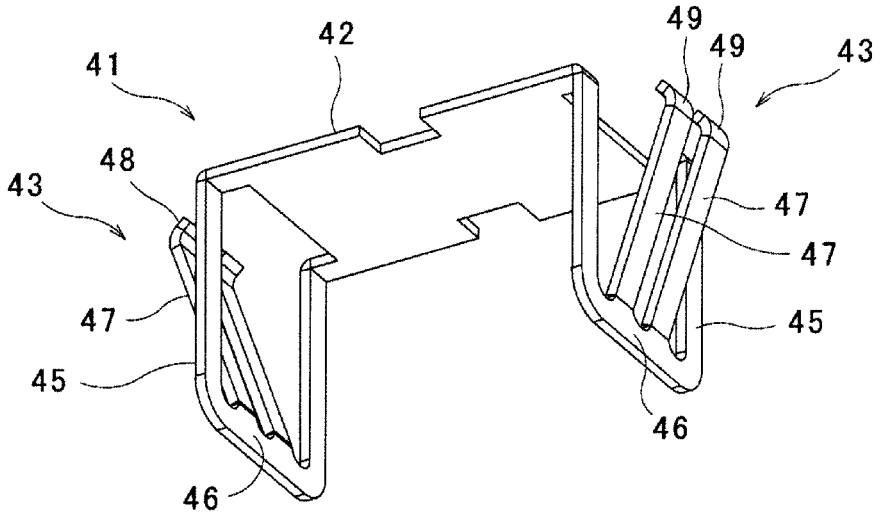

The slider 41 according to the present invention has a plate shape coupling body 42, and elastic arm sections 43 formed by bending both ends of the coupling body 42 as shown in FIGS. 3A and 3B. The elastic arm sections 43 include support pieces 45 of rectangular frame bodies extending vertically downward from both the ends of the coupling body 42, lower sides 46 coupled to the support pieces 45, and elastic pieces 47 sheared and bent outward from the lower sides 46 into a V shape. Movable contact portions 48, 48 to be brought into sliding contact with the insulation portion 26 of the insulating wall section 22 or the first fixing terminal 31 while pressing the insulation portion or the first fixing terminal from one side, and movable contact portions 49, 49 to be brought into sliding contact with the second fixing terminal 36 while pressing the second fixing terminal from one side are formed in tip ends of the elastic pieces 47. Since the elastic arm sections 43 extend in the longitudinal direction of the slider 41, at the time of ensuring a predetermined contact force, a better contact between the two terminals can be ensured. Therefore, even when variations are generated in contact follow due to variations in part precision and assembling precision, variations in a contact force can be minimized. As a result, a switch with low variations in operation characteristics can be obtained. Since a space in the longitudinal direction of the slider 41, that is, a space in the width direction of the switch 11 can be effectively utilized, the switch 11 can be downsized in such direction. Further, since the V shape elastic arm sections 43 include the support pieces 45 and the elastic pieces 47, stock layout of the slider 41 becomes efficient, so that a stock width can be narrowed.

Next, an assembling method of the switch 11 including the above constituent members will be described.

Firstly, the cap 15 is fitted into the annular groove 18 of the casing 17. The push button 12 is inserted inside the casing 17 movably in the axial direction, so that the upper end of the pressed section 14 protrudes from the cap 15. It should be noted that the slider 41 is insert-molded to the recessed portion of the seat 13 of the push button 12 in advance. Thereby, the slider 41 is integrated with the push button 12, so that the number of parts and the number of assembling steps are decreased, and the variations in the operation characteristics of the slider 41 are eliminated, so that contact reliability can be enhanced. However, the slider 41 may be fixed to the push button 12 by thermal caulking or snap-fitting. At this time, a selection range of the assembling method is widened, so that the switch is easily manufactured. After that, an upper end of a coil spring 50 is abutted with the recessed portion of the seat 13.

The first fixing terminal 31 is insert-molded to the base 21 in advance so that the first inward projection 35*a* and the first outward projection 35*b* of the first fixing terminal 31 are buried in the base 21.

Figure 4A:
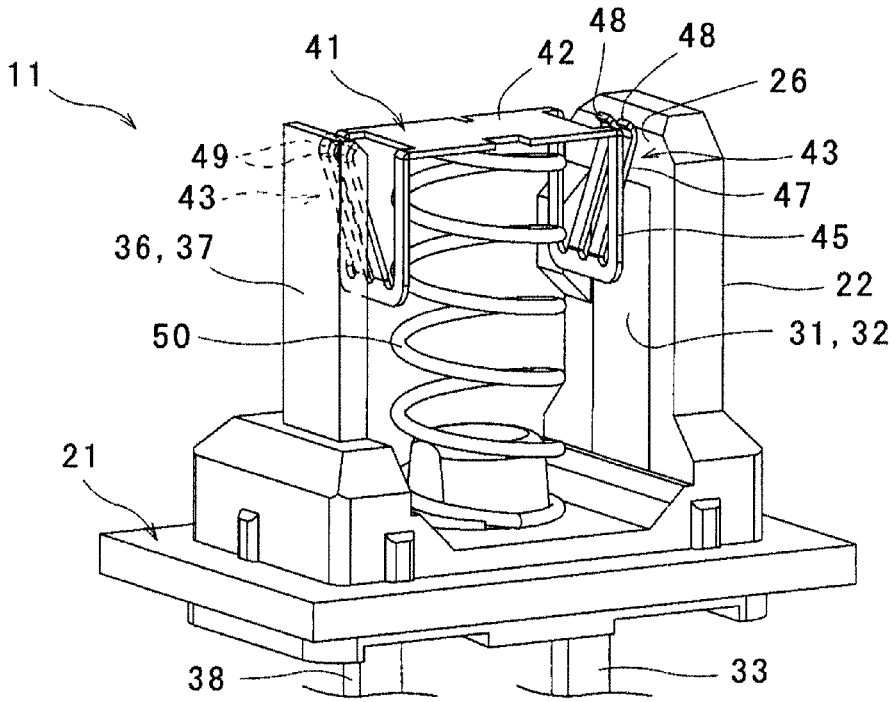
FIG. 4A is a perspective view showing a relationship between the slider and a first fixing terminal in a state that the switch of FIGS. 2A and 2B is at an initial position.
Figure 4B:
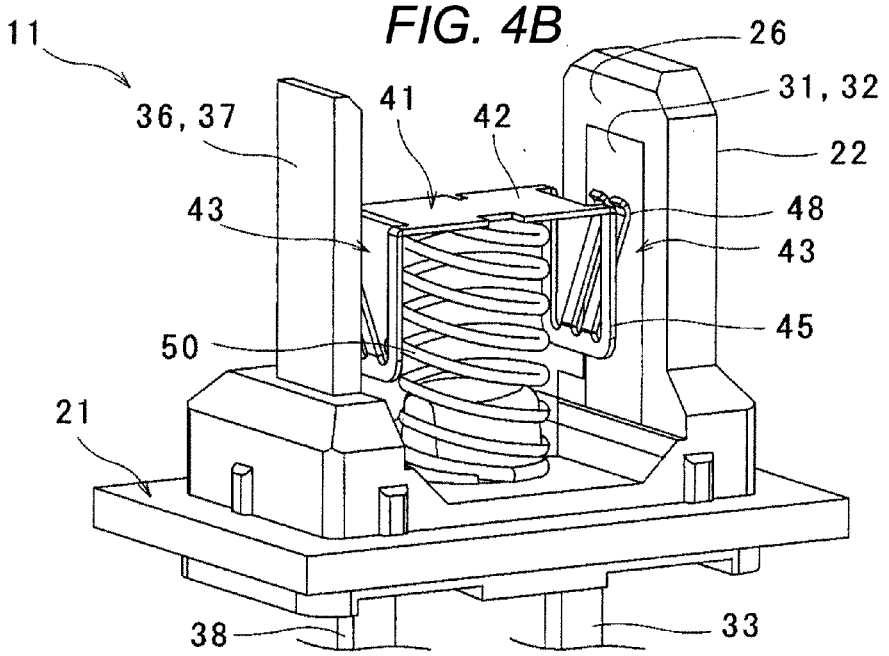
FIG. 4B is a perspective view corresponding to FIG. 4A in which the switch is at an operation position.
Figure 5A:
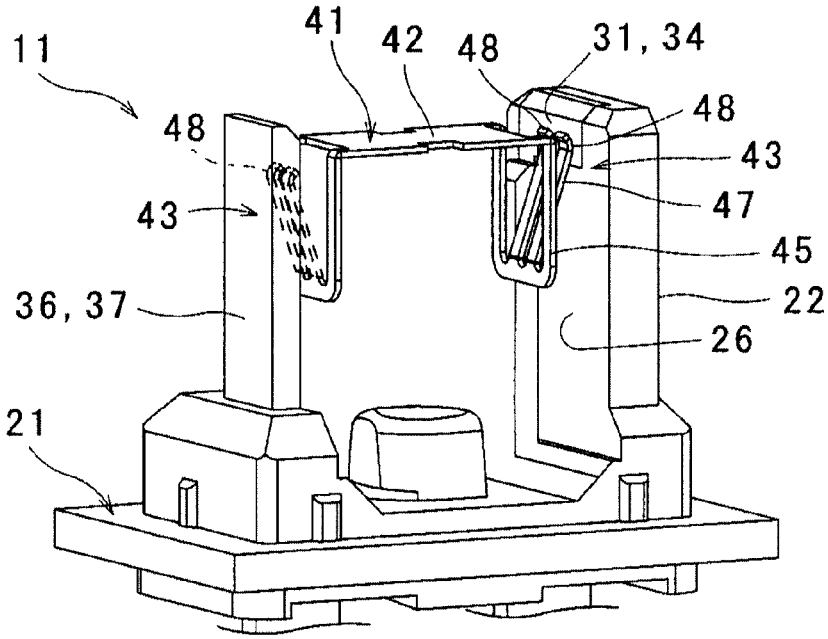
FIG. 5A is a perspective view showing a relationship between a slider and a first fixing terminal in a state that a switch according to a modified example of the first embodiment is at an initial position.
Figure 5B:
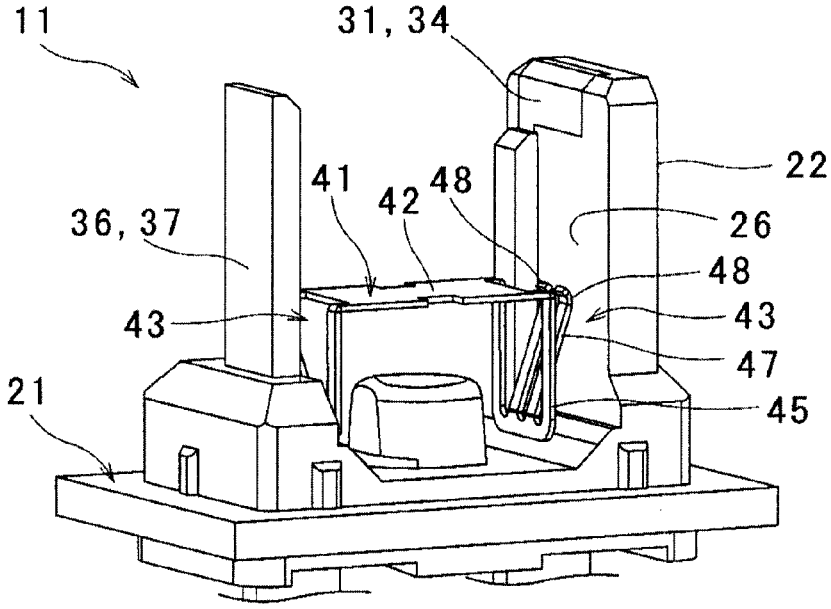
FIG. 5B is a perspective view corresponding to FIG. 5A in which the switch is at an operation position.
Figure 6A:
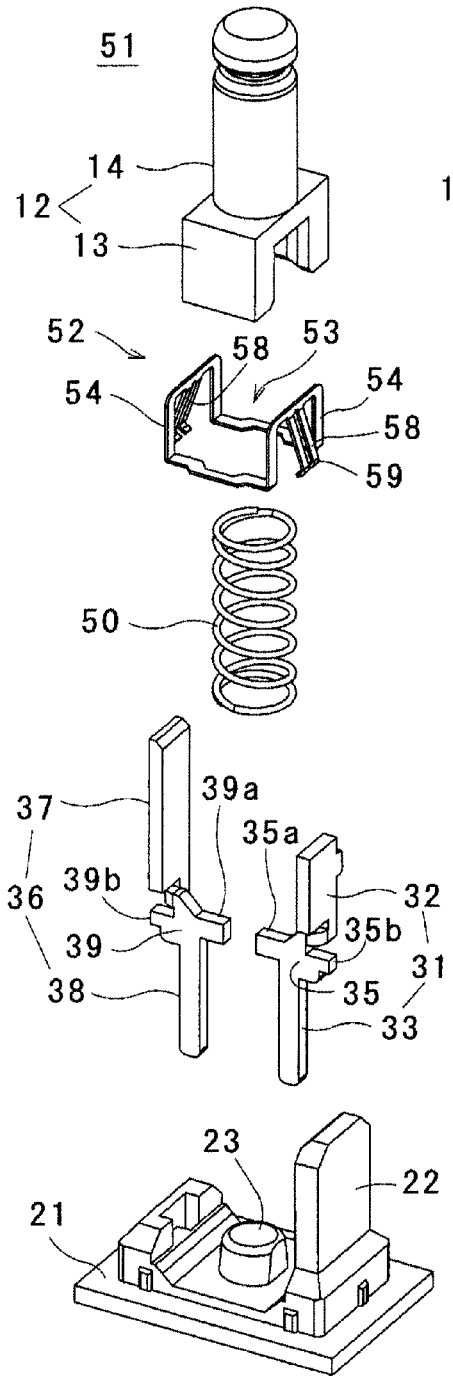
FIG. 6A is an exploded perspective view in which a switch according to a second embodiment of the present invention is seen from the upper side.
Figure 6B:
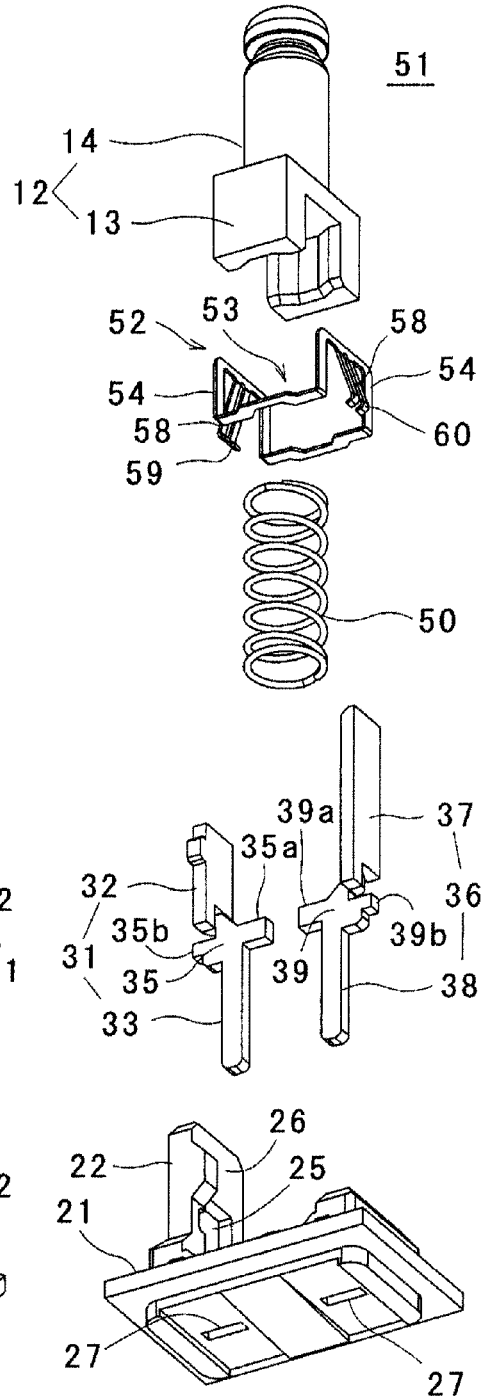

At this time, the first slide contact section 32 of the first fixing terminal 31 is buried in the burying groove 25 of the insulating wall section 22 so as to be flush with the insulation portion 26 (refer to FIG. 4A). Therefore, the slider 41 can be brought into smooth sliding contact between the insulation portion 26 and the first fixing terminal 31. Similarly, the second fixing terminal 36 is insert-molded to the base 21 in advance so that the second inward projection 39*a* and the second outward projection 39*b* of the second fixing terminal 36 are buried in the base 21. Thereby, strength for supporting the first fixing terminal 31 and the second fixing terminal 36 onto the base 21 is enhanced, so that the first fixing terminal 31 and the second fixing terminal 36 are not easily dropped from the base 21. Since a creeping distance between the base 21 and the first fixing terminal 31 and the second fixing terminal 36 can be extended, sealing airtightness can be improved.

Further, the base 21 is installed in the opening of the casing 17 so that the cylindrical rib 23 of the base 21 is engaged with the other end of the coil spring 50 so as to compress the coil spring 50, and the first fixing terminal 31 and the second fixing terminal 36 are accommodated inside the casing 17. At this time, since the elastic arm sections 43 are formed in a V shape, the first fixing terminal 31 and the second fixing terminal 36 can be inserted and assembled inside the switch 11 so as to be guided by the elastic arm sections 43, so that an assembling property is improved. Thereby, the switch 11 is completed.

Next, operations of the assembled switch 11 will be described.

When the switch 11 is assembled, as shown in FIG. 4A, the slider 41 is biased by the coil spring 50 and placed at an initial position on the upper side (position before pressing the pressed section 14 of the push button 12). At this time, the movable contact portions 48, 48 on the one side are abutted with the insulation portion 26 of the insulating wall section 22, and the movable contact portions 49, 49 on the other side are abutted with the second slide contact section 37 of the second fixing terminal 36, so that the switch is insulated. When the pressed section 14 of the push button 12 is pressed from the exterior in this state, the push button 12 is moved with the slider 41 downward in the axial direction against a bias force of the coil spring 50. Then, in the slider 41, the elastic arm sections 43 are moved downward and brought into sliding contact with the first slide contact section 32 of the first fixing terminal 31 after the insulation portion 26. When the slider reaches an operation position shown in FIG. 4B, the movable contact portions 48, 48 on the one side are abutted with the first slide contact section 32 and the movable contact portions 49, 49 on the other side are abutted with the second slide contact section 37, so that the switch conducts. Thereby, the external terminals respectively connected to the first and second externally connecting terminal sections 33, 38 are brought into a conduction state. When a pressing force toward the pressed section 14 of the push button 12 is cancelled, the push button 12 is moved with the slider 41 upward in the axial direction by the bias force of the coil spring 50. Then, in the slider 41, the elastic arm sections 43 are moved upward, brought into sliding contact with the insulation portion 26 after the first slide contact section 32, and returned to the initial position. Therefore, the movable contact portions 48, 48 on the one side are abutted with the insulation portion 26 of the insulating wall section 22, and the movable contact portions 49, 49 on the other side are abutted with the second slide contact section 37, so that the switch is brought into non-conducting state. It should be noted that when the elastic arm sections 43 are formed into a V shape, a distance from a center axis of the push button 12 to the movable contact portions 48, 49 is shortened. Thus, even in a case where the push button 12 is inclined, an influence on a contact switch position can be reduced.

The present invention is not limited to the first embodiment but can be variously modified.

In the first embodiment, the first slide contact section 32 of the first fixing terminal 31 is provided on the lower side of the insulation portion 26. However, the present invention is not limited to this. For example, as in a modified example of the first embodiment shown in FIGS. 5A and 5B, a configuration that a first slide contact section 34 of a first fixing terminal 31 is provided on an upper inner surface of an insulating wall section 22 and an insulation portion 26 is formed on the lower side may be adopted. Thereby, when a slider 41 is at an initial position (refer to FIG. 5A), movable contact portions 48, 48 on the one side are abutted with the first slide contact section 34 and movable contact portions 49, 49 on the other side are abutted with a second slide contact section 37, so that the switch conducts. When a push button (not shown) is pressed and the slider 41 is at an operation position (FIG. 5B), the movable contact portions 48, 48 on the one side are abutted with the insulation portion 26 of the insulating wall section 22 and the movable contact portions 49, 49 on the other side are abutted with the second slide contact section 37, so that the switch is insulated and hence a conduction state of the external terminals may be switched. It should be noted that in FIGS. 5A and 5B, for convenience of description, a push button 12 and a coil spring 50 are not shown. The same is applied to the following figures.

Second Embodiment

Figure 7A:
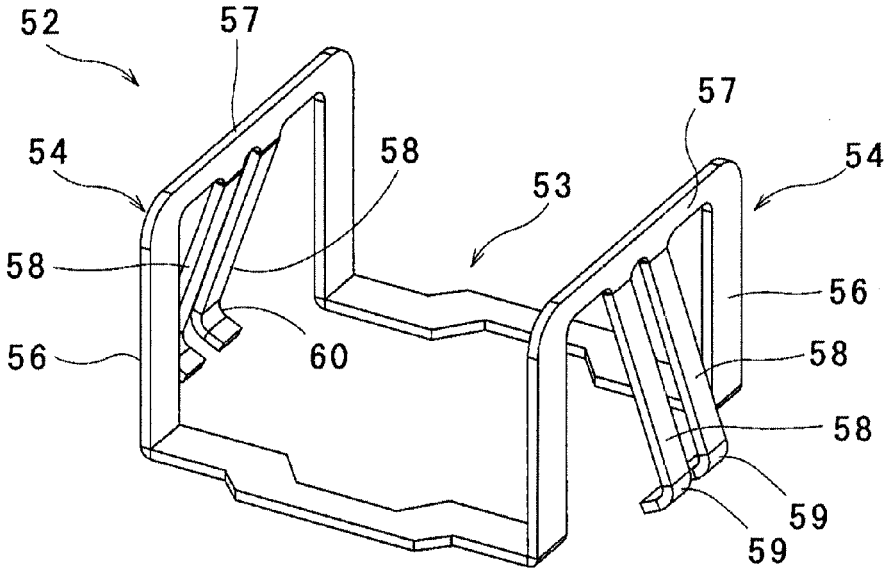
FIG. 7A is an enlarged perspective view of parts of a slider of FIGS. 6A and 6B.

In the first embodiment, the elastic pieces 47 of the slider 41 are sheared and bent outward from the lower sides 46 of the support pieces 45. However, the present invention is not limited to this. For example, as in a switch 51 according to a second embodiment shown in FIGS. 6A and 6B, a slider 52 may have a coupling body 53 including a pair of facing frame bodies, and elastic arm sections 54 formed by bending both ends of the coupling body 53. As shown in FIG. 7A, the elastic arm sections 54 include support pieces 56 of rectangular frame bodies extending vertically upward from both edges of the coupling body 53, upper sides 57 coupled to the support pieces 56, and elastic pieces 58 sheared and bent outward from the upper sides into a V shape which is made by turning the shape of the first embodiment upside down. Movable contact portions 59, 59 to be brought into sliding contact with an insulation portion 26 of an insulating wall section 22 or a first fixing terminal 31 while pressing the insulation portion or the first fixing terminal from one side, and movable contact portions 60, 60 to be brought into sliding contact with a second fixing terminal 36 while pressing the second fixing terminal from one side are formed in tip ends of the elastic pieces 58.

Figure 7B:
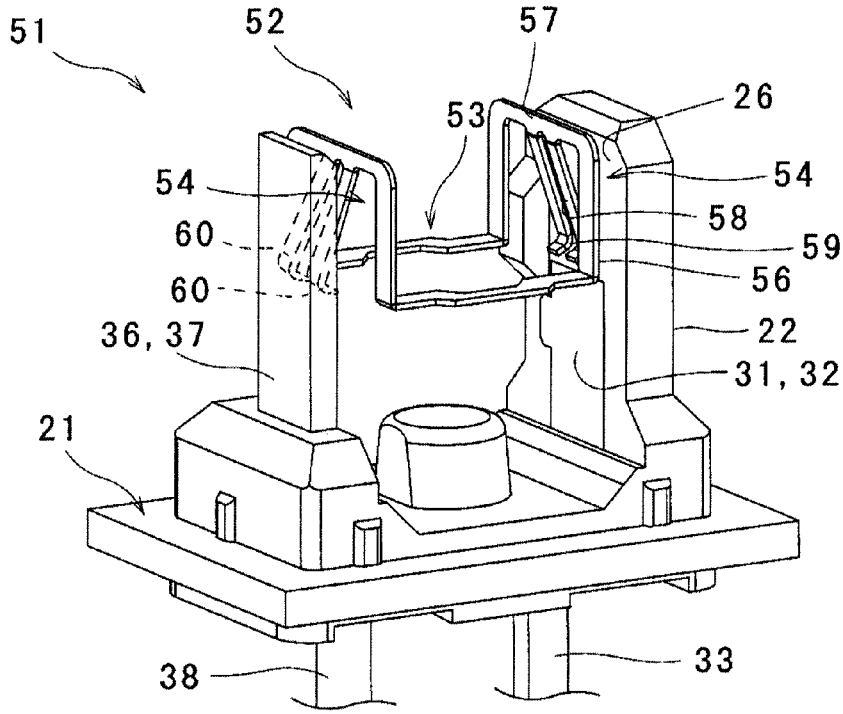
FIG. 7B is a perspective view showing a relationship between the slider and a first fixing terminal in a state that the slider of FIG. 7A is assembled to the switch.

In a state that the slider 52 is assembled to the switch 51, the coupling body 53 is insert-molded to a lower portion of a seat 13 of a push button 12, and a coil spring 50 is inserted through a clearance of the coupling body 53 and abutted with the seat 13. As shown in FIG. 7B, a first slide contact section 32 of the first fixing terminal 31 is formed to be shorter than the first embodiment, and the insulation portion 26 of the insulating wall section 22 is formed to be long in the axial direction. Apart from the point, the second embodiment is the same as the first embodiment. Thus, the same parts will be given the same reference numerals and description thereof will not be given.

When the switch 51 is assembled, at an initial position (refer to FIG. 7B), the movable contact portions 59, 59 on the one side are abutted with the insulation portion 26 of the insulating wall section 22, and the movable contact portions 60, 60 on the other side are abutted with a second slide contact section 37, so that the switch is insulated. When the push button 12 is pressed and the slider 52 is moved downward and reaches an operation position, the movable contact portions 59, 59 on the one side are abutted with the first slide contact section 32 and the movable contact portions 60, 60 on the other side are abutted with the second slide contact section 37, so that the switch conducts. Since returning is the same as the first embodiment, description thereof will not be given.

Third Embodiment

Figure 8A:
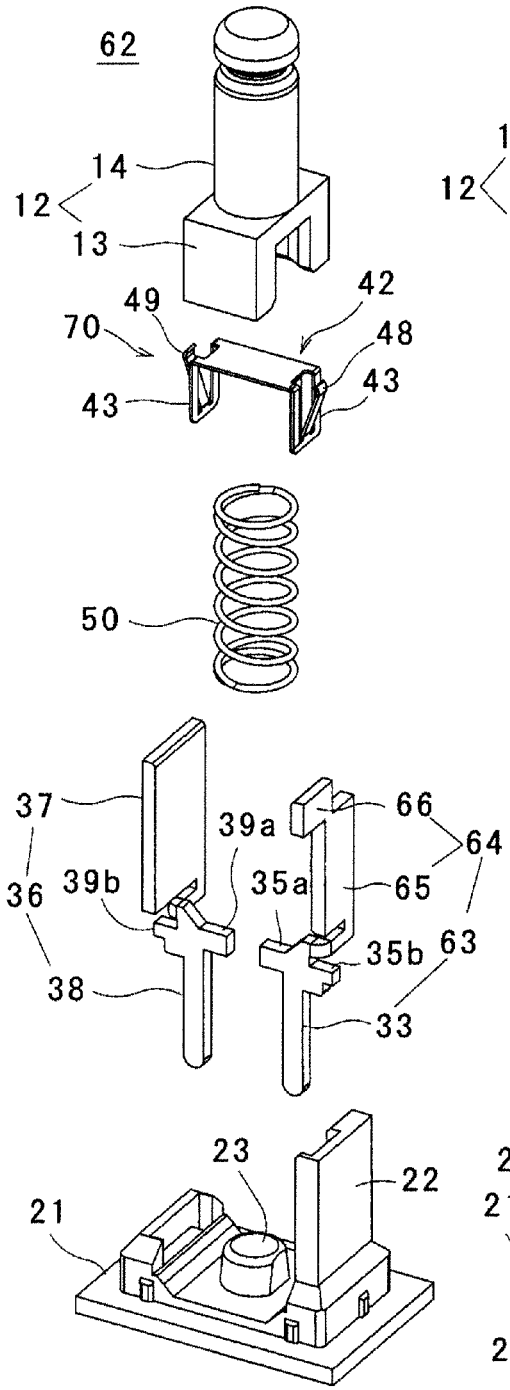
FIG. 8A is an exploded perspective view in which a switch according to a third embodiment of the present invention is seen from the upper side.
Figure 8B:
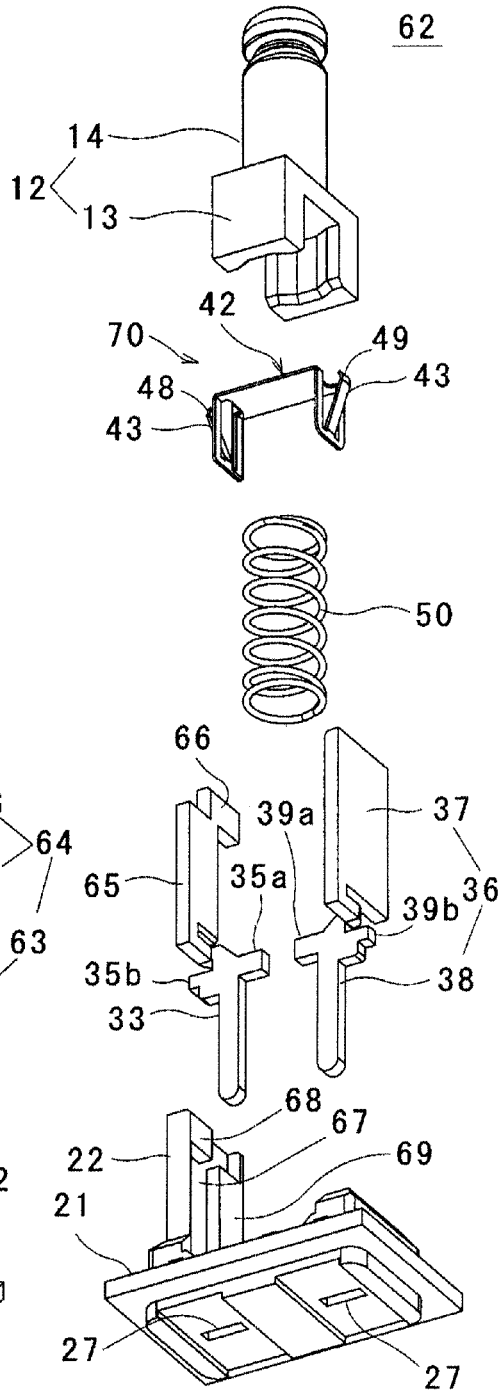

In a first fixing terminal 63 of a switch 62 according to a third embodiment shown in FIGS. 8A and 8B, a first contact section 64 has a rectangular plate shape sliding piece 65, and a sliding block 66 extending obliquely upward from an upper corner portion of the sliding piece 65. A burying groove 67 of an insulating wall section 22 is formed into a shape corresponding to the first contact section 64. Thereby, two insulation portions 68, 69 are formed so as to face each other across the first contact section 64 buried in the burying groove 67 in the insulating wall section 22 (refer to FIG. 10A).

Figure 9:
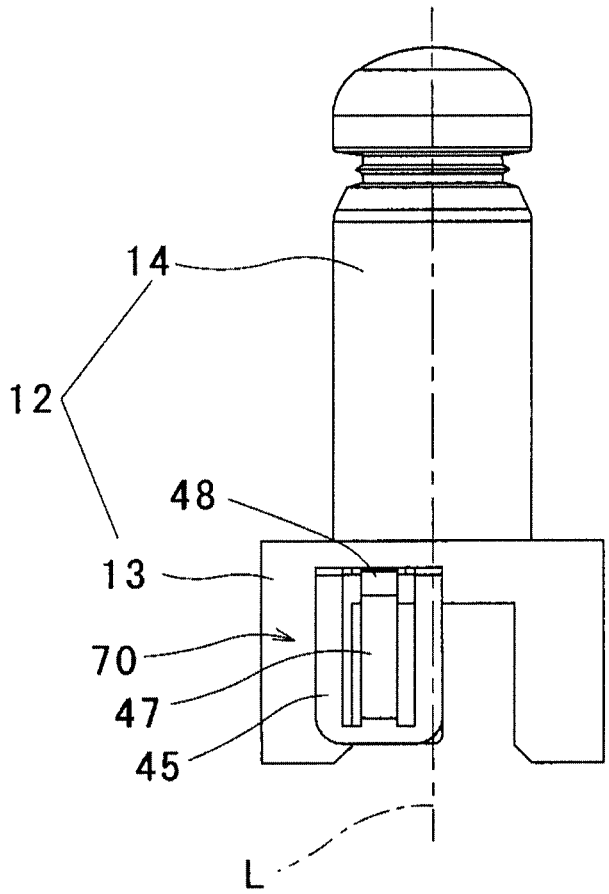
FIG. 9 is a side view of a state that the slider is insert-molded to a push button.
Figure 10A:
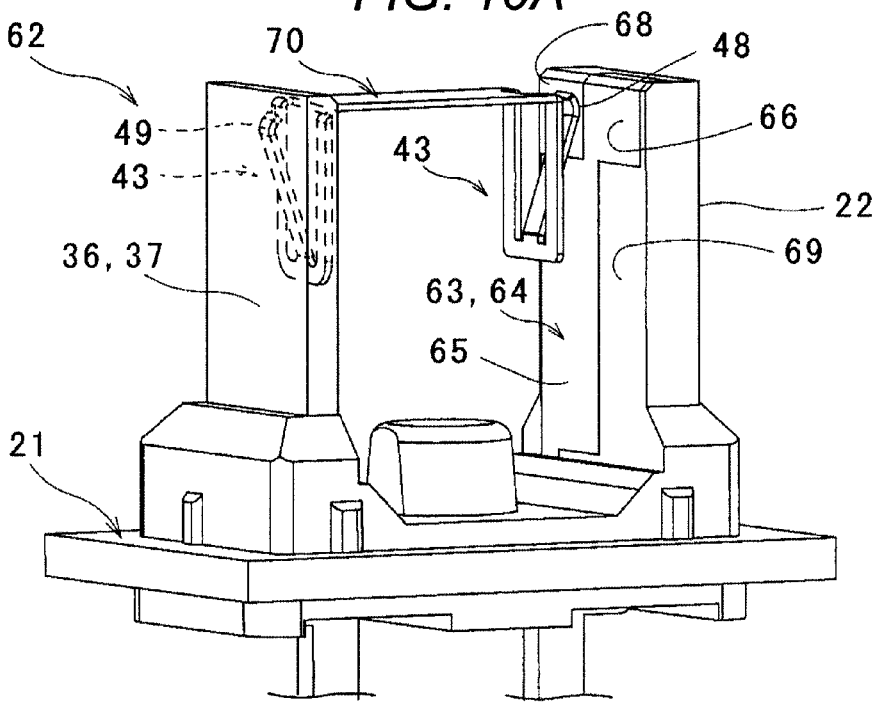
FIG. 10A is a perspective view showing a relationship between the slider and the first fixing terminal in a state that the switch adopting an always-open contact structure in FIGS. 8A and 8B is at an initial position.
Figure 10B:
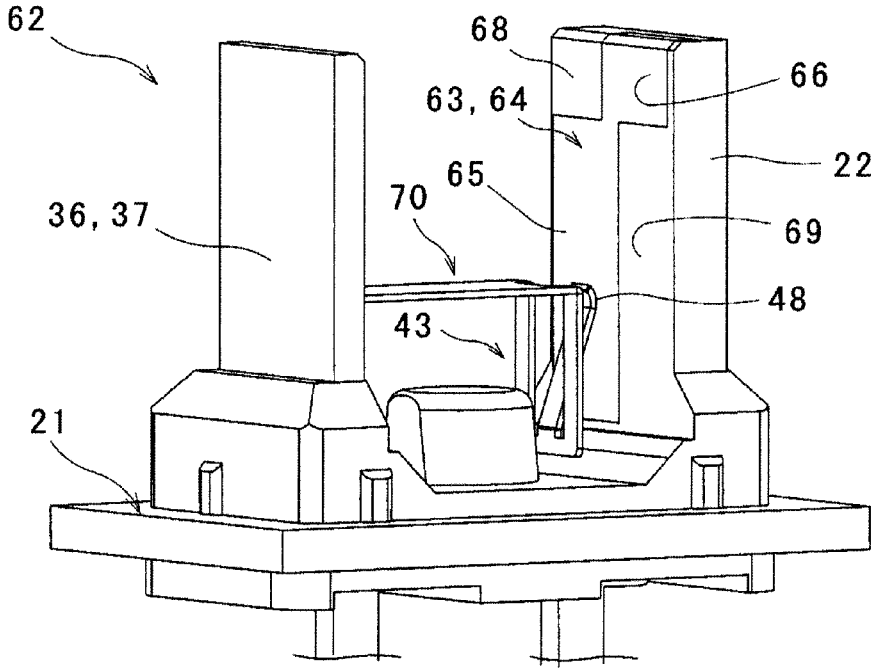
FIG. 10B is a perspective view corresponding to FIG. 10A in which the switch is at an operation position.
Figure 11A:
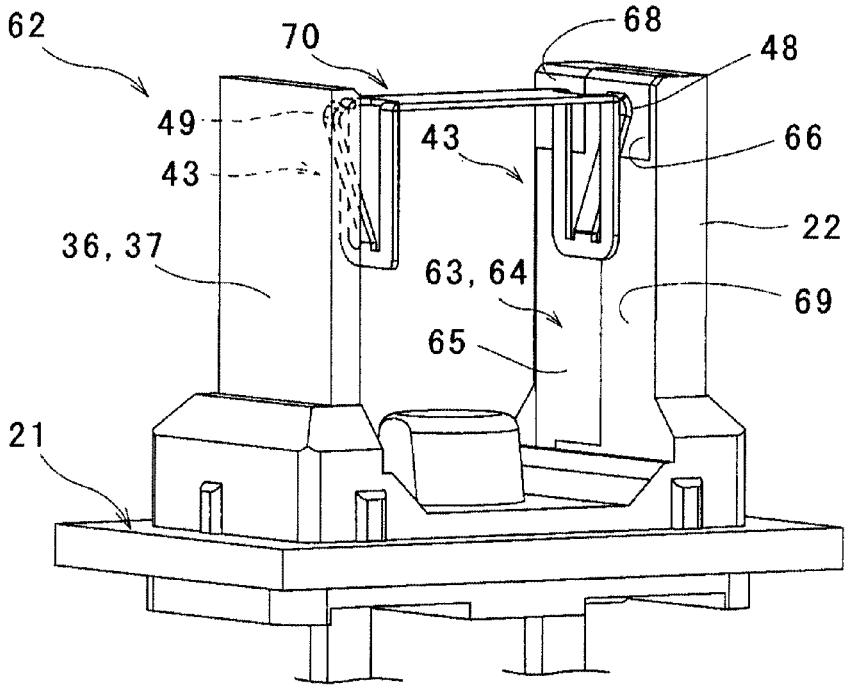
FIG. 11A is a perspective view showing a relationship between the slider and the first fixing terminal in a state that the switch adopting an always-closed contact structure in FIGS. 8A and 8B is at an initial position.
Figure 11B:
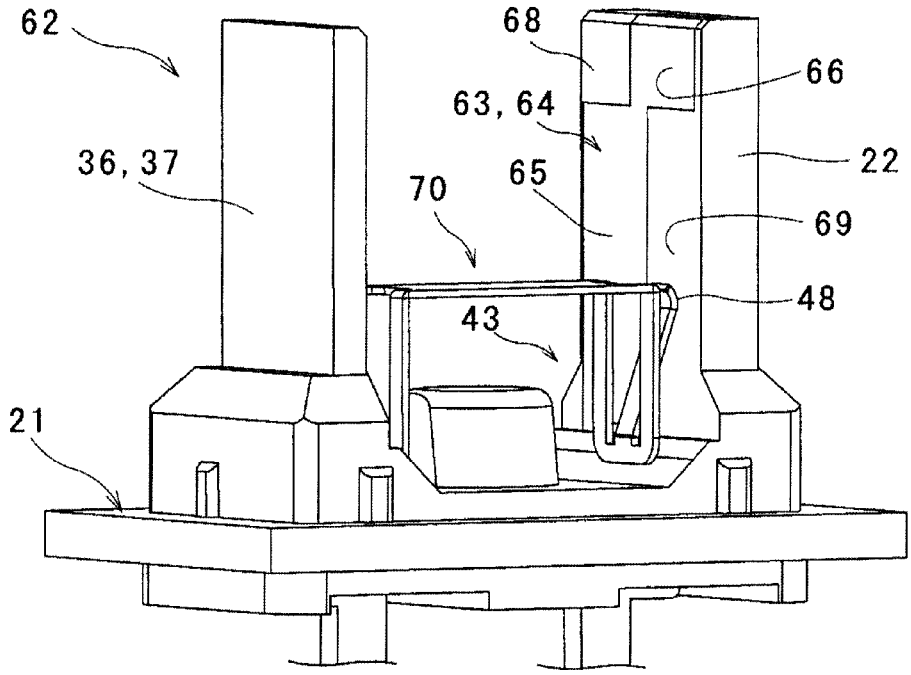
FIG. 11B is a perspective view corresponding to FIG. 11A in which the switch is at an operation position.

Further, as shown in FIGS. 8A and 8B, elastic arm sections 43 of a slider 70 respectively have one movable contact portion 48 and one movable contact portion 49, and the slider 70 is formed to be narrow. As shown in FIG. 9, the slider 70 is insert-molded to a seat 13 of a push button 12 while being slightly displaced from a center line L. That is, the movable contact portions 48, 49 are arranged at positions which are different from a rotation symmetry with respect to a center axis of the push button 12. Therefore, the slider 70 can be arranged in an always-open contact structure shown in FIGS. 10A and 10B, and an always-closed contact structure shown in FIGS. 11A and 11B, the always-closed contact structure being formed by rotating the slider 70 by 180 degrees with respect to the center axis of the push button 12 from the always-open contact structure. Apart from the point, the third embodiment is the same as the first embodiment. Thus, the same parts will be given the same reference numerals and description thereof will not be given.

When the switch 62 is assembled, in the always-open contact structure, at an initial position (refer to FIG. 10A), the movable contact portion 48 on the one side is abutted with the insulation portion 68 of the insulating wall section 22, and the movable contact portion 49 on the other side is abutted with a second slide contact section 37, so that the switch is insulated. When the push button 12 is pressed and the slider 70 is moved downward and reaches an operation position (refer to FIG. 10B), the movable contact portion 48 on the one side is abutted with the sliding piece 65 of the first fixing terminal 63 and the movable contact portion 49 on the other side is abutted with the second slide contact section 37, so that the switch conducts. Since returning is the same as the first embodiment, description thereof will not be given.

Meanwhile, when the slider 70 is rotated by 180 degrees with respect to the center axis of the push button 12, the structure becomes the always-closed contact structure. That is, at an initial position (refer to FIG. 11A), the movable contact portion 48 on the one side is abutted with the sliding block 66 of the first fixing terminal 63 and the movable contact portion 49 on the other side is abutted with the second slide contact section 37, so that the switch conducts. When the push button 12 is pressed and the slider 70 is moved downward and reaches an operation position (refer to FIG. 11B), the movable contact portion 48 on the one side is abutted with the insulation portion 69 of the insulating wall section 22 and the movable contact portion 49 on the other side is abutted with the second slide contact section 37, so that the switch is insulated. Since returning is the same as the first embodiment, description thereof will not be given. As described above, switches of two specifications including the always-closed contact structure and the always-open contact structure can be made by the same constituent parts.

Fourth Embodiment

Figure 12A:
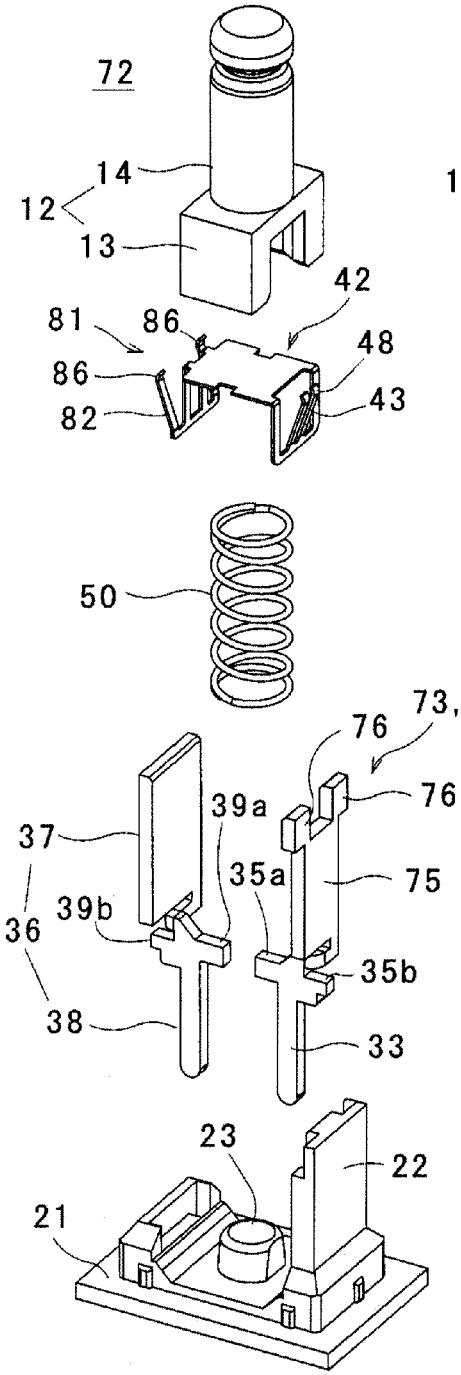
FIG. 12A is an exploded perspective view in which a switch according to a fourth embodiment of the present invention is seen from the upper side.
Figure 12B:
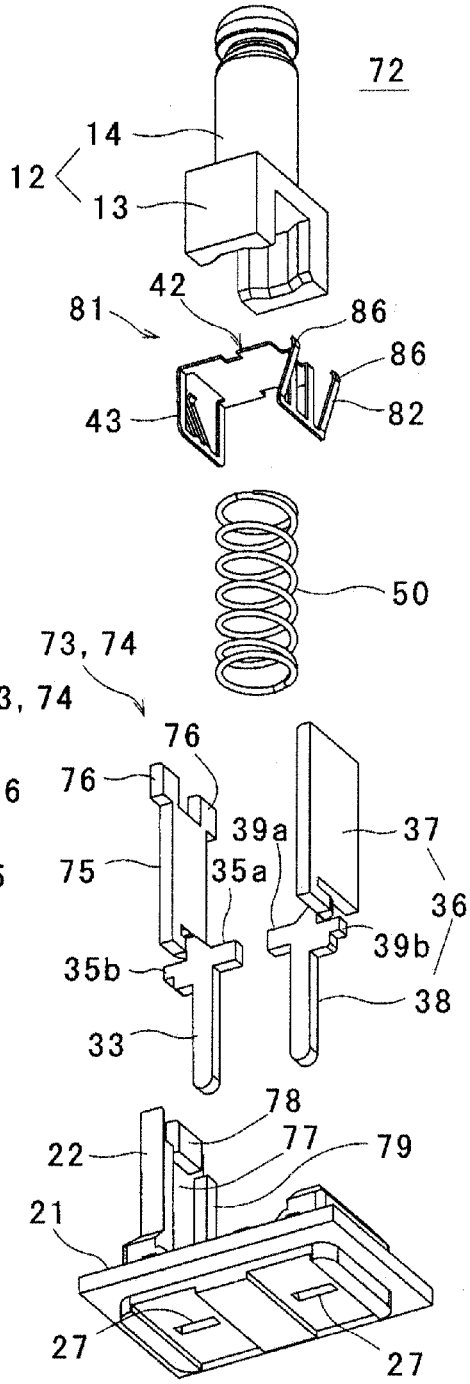
Figure 13A:
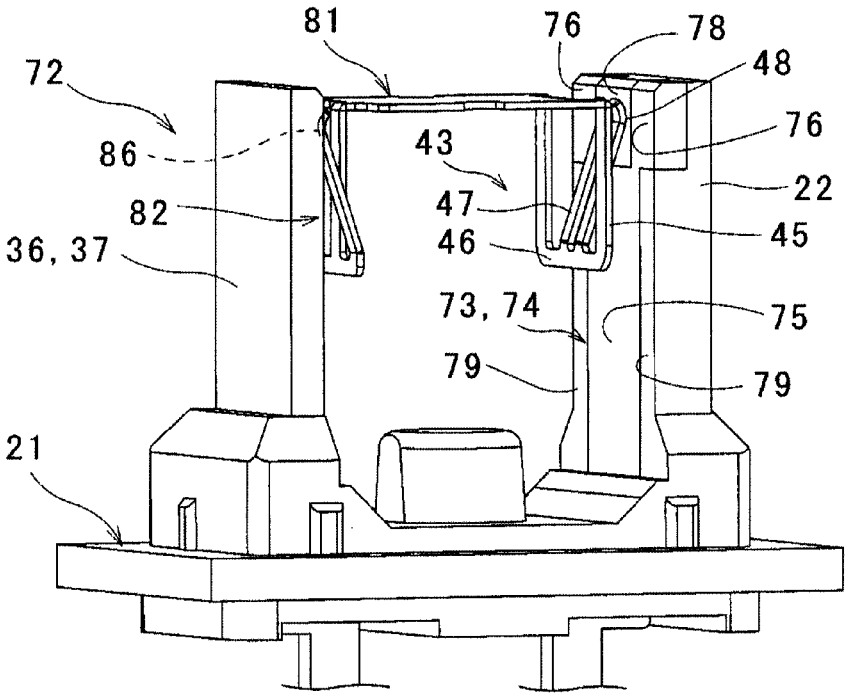
FIG. 13A is a perspective view showing a relationship between a slider and a first fixing terminal in a state that the switch adopting an always-open contact structure in FIGS. 12A and 12B is at an initial position.
Figure 13B:
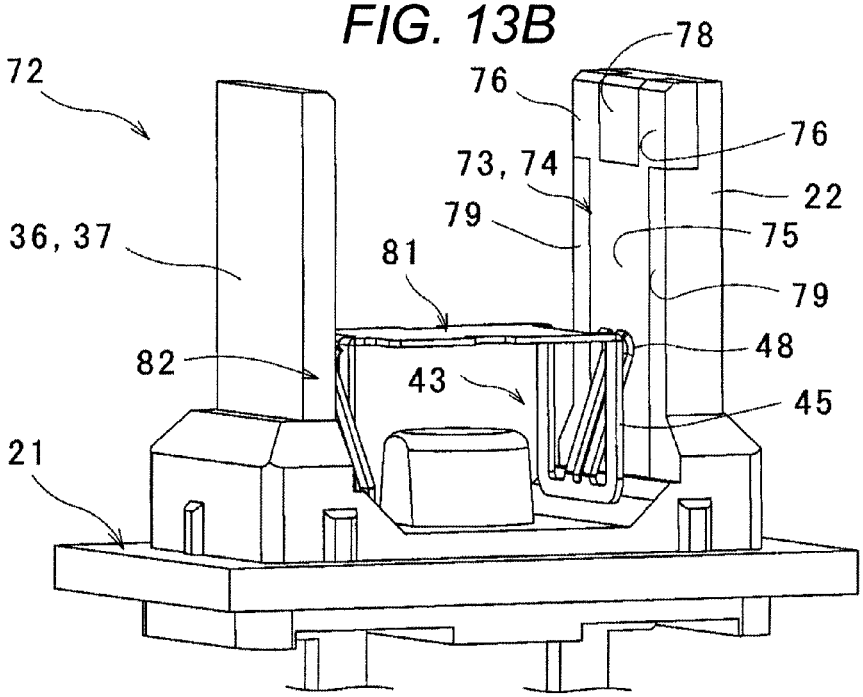
FIG. 13B is a perspective view corresponding to FIG. 13A in which the switch is at an operation position.

In a first fixing terminal 73 of a switch 72 according to a fourth embodiment shown in FIGS. 12A and 12B, a first contact section 74 has a rectangular plate shape sliding piece 75, and a pair of sliding blocks 76 extending obliquely upward from both upper corner portions of the sliding piece 75. A burying groove 77 of an insulating wall section 22 is formed into a shape corresponding to the first contact section 74. Thereby, a rectangular insulation portion 78 formed in a center of an upper portion, and a pair of insulation portions 79 formed in parallel along both lower edges of the rectangular insulation portion 78 are formed in the insulating wall section 22 (refer to FIG. 13B).

Figure 14A:
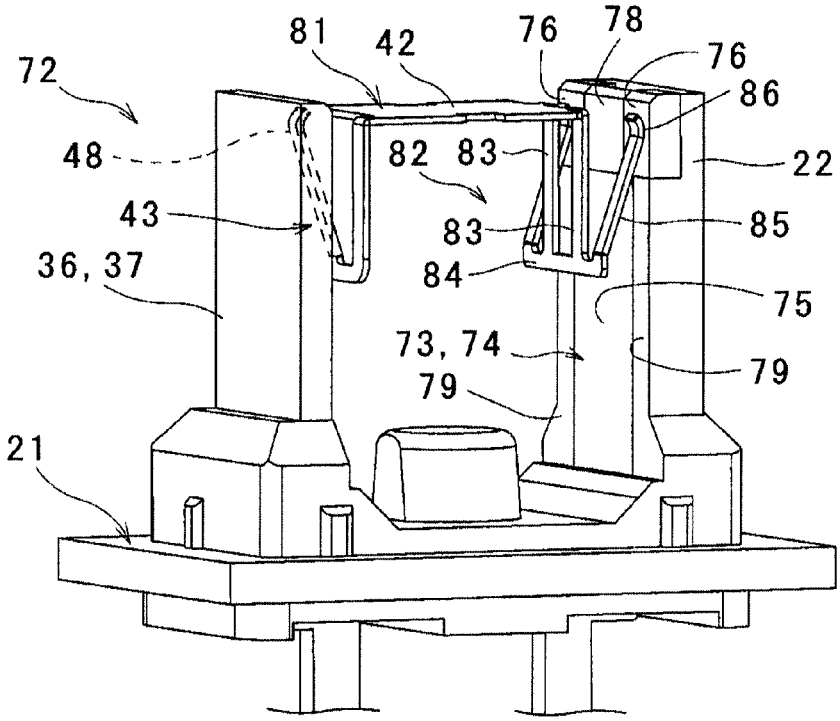
FIG. 14A is a perspective view showing a relationship between the slider and the first fixing terminal in a state that the switch adopting an always-closed contact structure in FIGS. 12A and 12B is at an initial position.
Figure 14B:
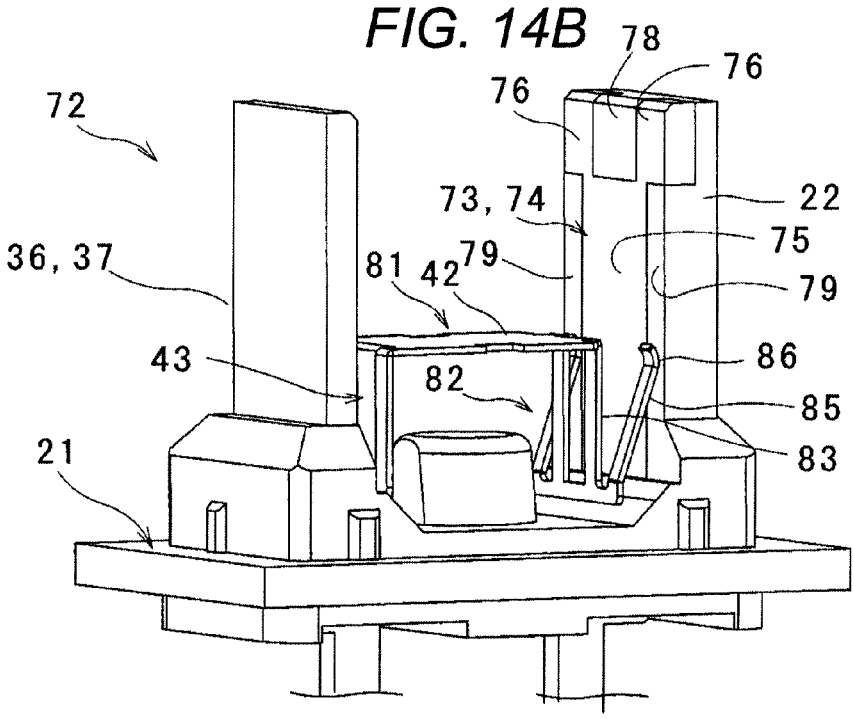
FIG. 14B is a perspective view corresponding to FIG. 14A in which the switch is at an operation position.

Further, a slider 81 is provided with an elastic arm section 43 formed by bending one end of a coupling body 42, and a switching elastic arm section 82 formed by bending the other end. As shown in FIG. 14A, the switching elastic arm section 82 includes linear support pieces 83 extending vertically downward from a center of one side edge of the coupling body 42, a lower side 84 extending outward from both lower ends of the support pieces 83, and elastic pieces 85 sheared and bent outward from both ends of the lower side 84 into a V shape. Movable contact portions 86 to be brought into sliding contact with the sliding blocks 76 or the insulation portions 79 while pressing the sliding blocks or the insulation portions from one side are formed in tip ends of the elastic pieces 85. That is, the movable contact portions 48, 86 are arranged at positions which are different from a rotation symmetry with respect to a center axis of a push button 12. Therefore, the slider 81 can be arranged in an always-open contact structure shown in FIGS. 13A and 13B, and an always-closed contact structure shown in FIGS. 14A and 14B, the always-closed contact structure being formed by rotating the slider 81 by 180 degrees with respect to the center axis of the push button 12 from the always-open contact structure. Apart from the point, the fourth embodiment is the same as the first embodiment. Thus, the same parts will be given the same reference numerals and description thereof will not be given.

When the switch 72 is assembled, in the always-open contact structure, at an initial position (refer to FIG. 13A), the movable contact portions 48, 48 on the one side are abutted with the insulation portion 78 of the insulating wall section 22, and the movable contact portions 86 on the other side are abutted with a second slide contact section 37, so that the switch is insulated. When the push button 12 is pressed and the slider 81 is moved downward and reaches an operation position (refer to FIG. 13B), the movable contact portions 48, 48 on the one side are abutted with the sliding piece 75 of the first fixing terminal 73 and the movable contact portions 86 on the other side are abutted with the second slide contact section 37, so that the switch conducts. Since returning is the same as the first embodiment, description thereof will not be given.

Meanwhile, when the slider 81 is rotated by 180 degrees with respect to the center axis of the push button 12, the structure becomes the always-closed contact structure. In the always-closed contact structure, at an initial position (refer to FIG. 14A), the movable contact portions 86, 86 on the one side are abutted with the sliding blocks 76, 76 of the first fixing terminal 73 and the movable contact portions 48, 48 on the other side are abutted with the second slide contact section 37, so that the switch conducts. When the push button 12 is pressed and the slider 81 is moved downward and reaches an operation position (refer to FIG. 14B), the movable contact portions 86, 86 on the one side are abutted with the insulation portions 79 of the insulating wall section 22 and the movable contact portions 48, 48 on the other side are abutted with the second slide contact section 37, so that the switch is insulated. Since returning is the same as the first embodiment, description thereof will not be given.

There has thus been shown and described a switch which fulfills all the objects and advantages sought therefore. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A switch comprising: a base; a pair of fixing terminals orientated to face each other, each including an externally connecting terminal section, said externally connecting terminal section extending through an upper surface and a lower surface of the base; an insulating wall section integrated with at least one of the fixing terminals; a push button movable upward and downward in an axial direction; and a slider movable upward and downward with the push button, wherein the slider has elastic arm sections in both ends thereof, the elastic arm sections having movable contact portions that are brought into sliding contact with the fixing terminals or the insulating wall section while pressing the fixing terminals or the insulating wall section from one side, and the switch configured to enable the movable contact portions to connect to and separate from the fixing terminals based on operation of said push button upward and downward, wherein the elastic arm sections include support pieces extending from both side edges of a coupling body and bent in single direction, the arm sections have elastic pieces sheared and bent outward from the support pieces into a V shape, and the movable contact portions are provided in tip ends of the elastic pieces.

2. The switch according to claim 1, wherein an inward surface of the fixing terminal and an inward surface of the insulating wall section are in a same plane.

3. The switch according to claim 1, wherein each of the fixing terminals include a slide contact section configured to be brought into sliding contact with the slider, and an externally connecting terminal section connectable to an external circuit, the slide contact section and the externally connecting terminal section are coupled so as to have a predetermined twist angle via a coupling section, and the coupling section is buried in the base.

4. The switch according to claim 1, wherein the movable contact portions provided on both sides of the slider are respectively arranged at positions which are different from a rotation symmetry with respect to a center axis of the push button, and the movable contact portion on one side of both the sides, comes in contact with the fixing terminal if the slider is rotated by 180° from an initial position with respect to the center axis in a state that one of the movable contact portions is in contact with the insulating wall section at an initial position serving as a position before pressing the push button.

5. The switch according to claim 1, wherein the slider is at least one of insert-molded to the push button, and integrated with the push button by thermal caulking or snap-fitting.

* * * * *